US005505355A

United States Patent [19]

Williams

[11] Patent Number: 5,505,355

[45] Date of Patent: Apr. 9, 1996

[54] PACK FOR CARRYING A GUN

[76] Inventor: Patrick D. Williams, 3379 Meg Ct., Simi Valley, Calif. 93063

[21] Appl. No.: 237,255

[22] Filed: May 2, 1994

[51] Int. Cl.[6] ..... A45F 5/00

[52] U.S. Cl. ..... 224/224; 224/911; 224/243

[58] Field of Search ..... 224/191, 192, 224/224, 225, 226, 227, 228, 229, 235, 236, 237, 238, 243, 911, 912; 190/100, 101, 118, 120, 125; 2/312; D3/223, 226, 227, 228, 230; 383/119

[56] References Cited

U.S. PATENT DOCUMENTS

| | | | |
|---|---|---|---|
| D. 238,725 | 2/1976 | Zerobnick | 224/224 |
| D. 347,940 | 6/1994 | Linscott | D3/226 |
| 1,559,270 | 10/1925 | Miller | 224/226 |
| 3,347,299 | 10/1967 | Alexander . | |
| 3,628,640 | 12/1971 | Molnar | 190/120 |
| 3,720,013 | 3/1973 | McDonald . | |
| 3,965,706 | 6/1976 | Davis | 190/120 |
| 4,029,243 | 6/1977 | Zerobnick et al. | 224/224 |
| 4,325,469 | 4/1982 | Gurian | 190/125 |
| 4,862,519 | 9/1989 | Bull | 224/224 |
| 4,898,310 | 2/1990 | Remington | 224/911 |
| 4,966,320 | 10/1990 | DeSantis et al. | 224/238 |
| 5,150,824 | 9/1992 | Alvarez et al. | 224/228 |
| 5,170,919 | 12/1992 | DeSantis et al. | 224/911 |
| 5,209,385 | 5/1993 | Ledesma | 224/228 |
| 5,228,609 | 7/1993 | Gregory | 224/224 |
| 5,234,145 | 8/1993 | Padin . | |
| 5,285,833 | 2/1994 | Haxby | 224/229 |
| 5,294,031 | 3/1994 | Volpei et al. | 224/911 |

OTHER PUBLICATIONS

Two photographs of gun pouch of unknown origin, identified by a product label as "GALCO, Phoenix, Arizona."

*Primary Examiner*—Henry J. Recla
*Assistant Examiner*—Gregory M. Vidovich
*Attorney, Agent, or Firm*—Irell & Manella

[57] ABSTRACT

A hand gun is completely concealed within a gun carrying pack. The pack is mounted on a wearer by a belt around the wearer's waist. The pack has a pouch, concealed behind an additional belt strap and clip, for carrying a hand gun. The pouch has front and rear walls. The front wall is permanently attached to the rear wall at the bottom and on one side, but releasably attached by two zippers located on a zipper track at the top and on the other side. The pouch completely conceals a hand gun carried within the pouch. The additional belt strap and clip are connected across the zipper track at the top corner between the releasably attached top and side. By unclipping the additional belt strap and clip, a wearer can pull open the zippers to open the pouch to access the hand gun carried within.

6 Claims, 1 Drawing Sheet

PACK FOR CARRYING A GUN

FIELD OF THE INVENTION

The present invention relates generally to the field of pouches or packs for carrying a gun on one's person.

BACKGROUND OF THE INVENTION

There are many situations when a person authorized to carry a hand gun wants to completely conceal the hand gun. For example, undercover, off-duty or plain-clothes law enforcement officers often have need to completely conceal a hand gun in situations where they are not wearing a jacket, and without providing significant discomfort. However, while concealment of the hand gun is desirable, the wearer must have ready access to the hand gun in emergency situations.

SUMMARY OF THE INVENTION

The present invention is directed to a gun pack that allows a wearer to completely hide a hand gun on his or her person, yet position the hand gun so that it is readily accessible for a "quick draw". This is provided according to present invention by utilizing a specially-designed gun pack which looks like a conventional carrying pouch often worn by men and women around the waist as a utilitarian article of fashion, which is sometimes referred to as a "fanny pack." However, the gun pack has a pouch formed by a front wall that is readily detachable from a rear wall to expose a hand gun carried within the pack. The gun pack can be attached by a belt to the wearer's waist.

According to one aspect of the present invention, a gun pack is provided, comprising: a rear wall of a pouch having a top, a bottom and side portions; a front wall of a pouch having a top, a bottom and side portions, permanently attached to the rear wall at the bottom portions of both walls and at one side portion of both walls, and defining a pouch between the front and rear walls for carrying a hand gun; readily releasable fastener means attaching the front wall and rear wall at the top portions and other side portions of both walls; means for mounting the backing on a wearer; and a strap with a releasable clip attached between the strap and the rear wall.

The readily releasable fastener means preferably comprise two zippers located on a single zipper track. The front and rear walls are preferably formed of a textile material (fabric), such as nylon, and preferably contain foam padding inside in order to hold a hand gun securely within the pouch.

It is the primary object of the present invention to provide for the effective concealment, yet ready access to, a hand gun. This and other objects of the invention will become clear from an inspection of the detailed description of the invention, and from the appended claims.

BRIEF DESCRIPTION OF THE DRAWINGS

A preferred embodiment of the system and method of the present invention is illustrated in and by the following drawings in which like reference numerals indicate like parts and in which.

DETAILED DESCRIPTION OF THE PREFERRED EMBODIMENTS

Figure 1:
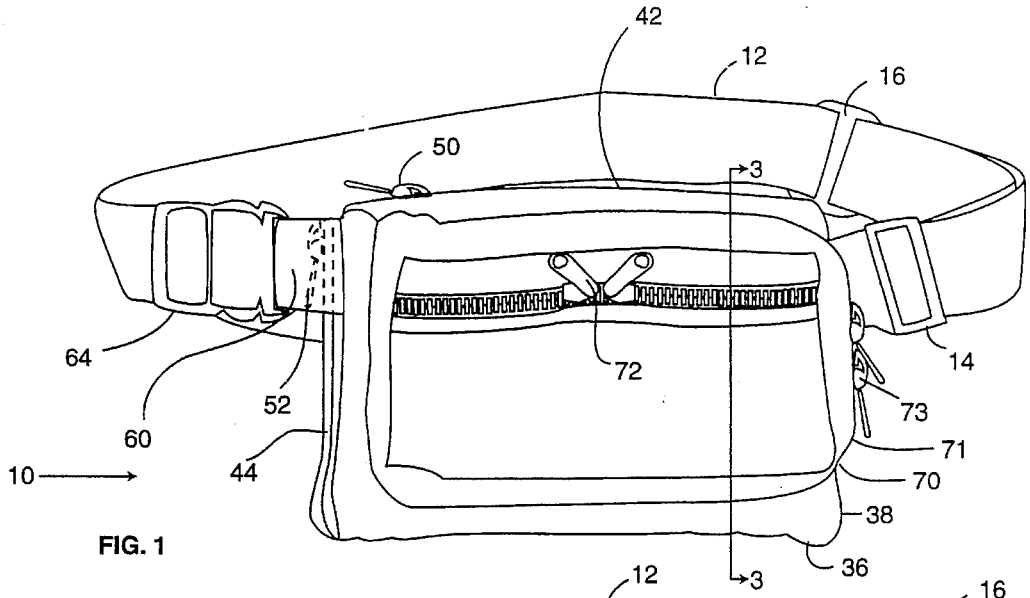
FIG. 1 is a front perspective view showing the gun pack in its closed position with a gun carried inside a pouch.
Figure 2:
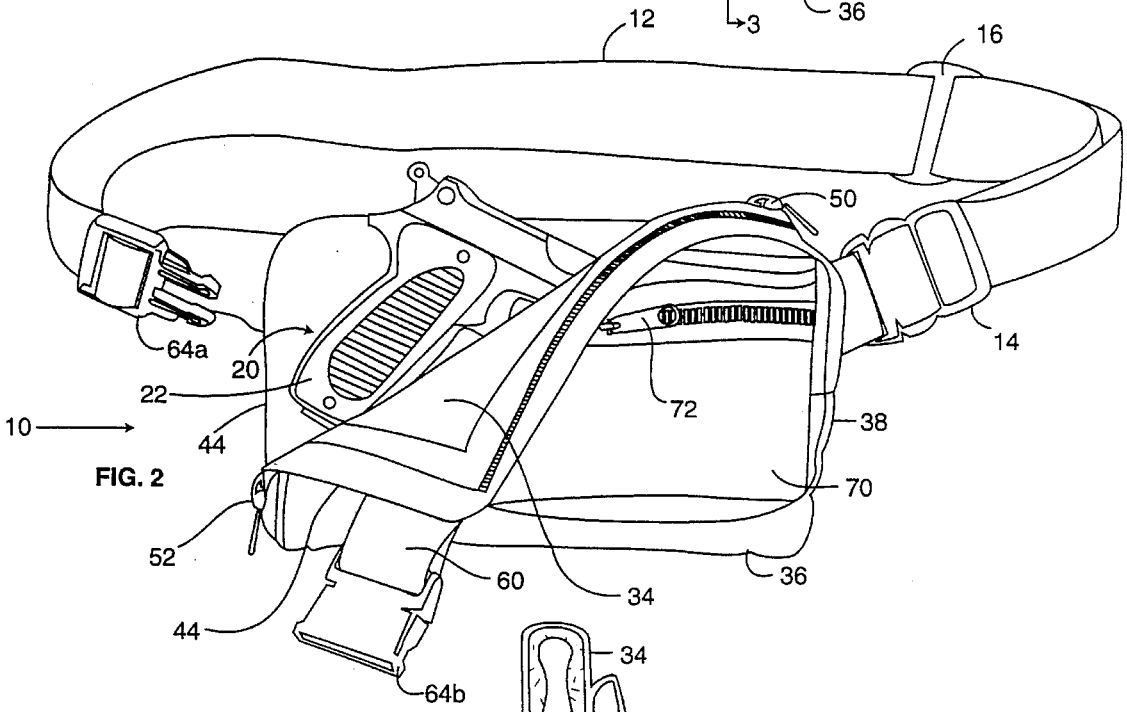
FIG. 2 is a front perspective view showing the gun pack in its open position and showing a gun carried inside being partial removed from the pouch.

A gun pack according to the present invention is shown in FIGS. 1 and 2 by the general reference number designation 10. The gun pack 10 is worn on the wearer's body at a convenient or "fashionable" position, as by utilizing a textile material belt 12 which has a belt clip 14 for opening and closing the belt around the wearer's waist. The belt clip 14 is preferably comprised of conventional male and female fasteners. The belt 12 also preferably contains an adjustment piece 16 to facilitate adjustment of the length of the belt for the wearer's comfort. While a belt 12 is shown, a shoulder strap, or other attachment device for mounting the gun pack 10 on the wearer, may be provided.

As seen more clearly in FIG. 2, the gun pack 10 has a pouch 20 for carrying a hand gun 22 in a readily accessible position. The gun pack 10 is shown with the pouch 20 in the closed position in FIG. 1, such that the hand gun 22 is concealed in the closed pouch 20.

Figure 3:
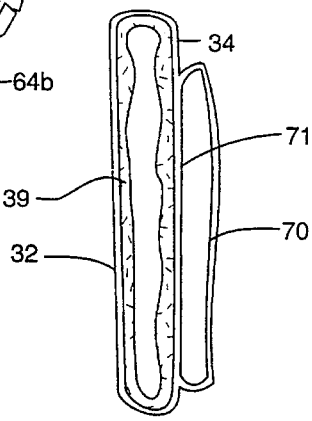
FIG. 3 is a side cross-sectional view of the gun pack, taken along the line 3—3 of FIG. 1, illustrating padding within the front and rear walls of the pouch for holding the gun securely within the rear pouch.

The pouch 20 is formed by a rear wall 32 and a front wall 34. The belt 12 is attached to the rear wall 32. The rear and front walls 32, 34 may be made of a wide variety of materials. As shown in FIG. 3, the rear and front walls are preferably constructed of a textile material such as nylon, and filled with a stiff but flexible fill material 39, such as foam rubber. The fill material 39 acts to secure the hand gun 22 in the pouch 20 while the wearer is moving while wearing the gun pack 10, thereby obviating the need for a holster within the pouch that might restrict the insertion and removal of the hand gun 22 from the pouch 20.

Both the rear and front walls 32, 34 have top, bottom and side portions. The rear and front walls 32, 34 are preferably permanently attached, by sewing, at their bottom portions 36 and at one side portion 38. The rear and front walls 32, 34 are releasably attached by a top zipper 50, for opening and closing the pouch 20 at the top portion 42 of the rear and front walls 32, 34, and by a side zipper 52, for opening and closing the pouch 20 at side portion 44 of the rear and front walls 32, 34.

The gun pack 10 is additionally provided with a concealing strap 60 attached to the side portion 44 of the front wall 34. The concealing strap 60 is attached to a female portion **64*b* of a concealing clip 64. The male portion of the concealing clip 64 is attached to the belt 12, near where the belt is attached to the rear wall 32 of the pouch 20. When the pouch 20 is closed, the zippers 50, 52 are located near each other near the top side corner of the gun pack 10, near the concealing clip 64. By inserting the male portion 64*a* into the female portion 64*b* of the concealing clip 64, thereby closing the clip, the concealing clip 64 is attached across the zippered opening (formed by zippers 50, 52) of the pouch 20, thereby acting as a further security against inadvertent opening of the pouch 20 containing the hand gun 22. Additionally, with the concealing clip 64 closed across the zippered opening of the pouch 20, the clip acts to conceal the existence of the pouch 20 containing the handgun 22. Thus the concealing clip 64 appears to be a normal clip attached to the belt 12, and acts to hide the existence of a pouch at the rear of the gun pack 10**.

The concealing clip 64 and front concealing strap 60 have a further advantage in providing a form of handle by which to open the pouch 20 very rapidly, and then providing easy, quick access to the handgun 22 inside. By unclipping the concealing clip 64 on the gun pack 10 as shown in FIG. 1 in the closed position, the wearer may then pull the front concealing strap 60 (which is attached to the front wall 34) forward. This pulling action will translate to the front wall 34, pulling it away from the rear wall 32, which then forces the zippers 50, 52 to move into the open position shown in FIG. 2.

In the typical method of utilization of the gun pack 10, the wearer inserts the hand gun 22 in the pouch 20, and pulls the zippers 50, 52 into the closed position as shown in FIG. 1. Then, the wearer closes the concealing clip 64 across the zippers 50, 52, as shown in FIG. 1. If quick, easy access to the gun 22 is desired, the wearer opens the concealing clip 64, and pulls on the front concealing strap 60 to pull the pouch 20 open. Then, the wearer inserts his or her hand into the pouch 20, secures his or her hand around the hand gun 22, and removes the hand gun 22.

It is also desirable to provide one or more pockets 70, 71 in the front wall 34, accessible from the exterior of the gun pack 10. The pockets 70, 71 are preferably closed by zippers 72, 73. While it is desirable that the pockets 70, 71 be useful as real pockets, for carrying ammunition or other articles, they may merely be simulated pockets and provide only a further disguising function causing the gun pack 10 to look as much like a conventional carrying pouch as possible.

What is claimed is:

1. A gun pack, comprising:

a pouch defining an enclosure for a gun, said pouch accessible by an opening along a portion of its periphery, and releasable fasteners on said pouch for closing said opening;

a belt attachable to a person's waist, said pouch being attachable to said belt; and a clip having a portion thereof attached to said belt and adapted to engage another portion of said clip attached to said pouch for maintaining said pouch closed and being located with respect to said releasable fasteners such that said pouch enclosure cannot be accessed without disengaging said clip portions.

2. A gun pack, comprising:

a pouch defined by a front wall and a rear wall, said front wall and said rear wall permanently attached at one side and at a bottom portion of said front wall and said rear wall, and said front wall and said rear wall releasably attached by fasteners at another side thereof and at a top portion of said front wall and said rear wall;

a belt, attached to said rear wall of said pouch; and a first portion of a clip connected to said belt and attachable to a second portion of a clip, said second portion of said clip attached to said front wall of said pouch such that said first portion of said clip engages said second portion of said clip across said fasteners that releasably attach said front wall and said rear wall.

3. A gun pack as recited in claim 2, wherein said front wall and said rear wall are each constructed with a fill material therein.

4. A gun pack as recited in claim 2, wherein said fasteners are zippers.

5. A gun pack as recited in claim 2, further comprising a pocket attached to said front wall of said pouch.

6. A gun pack as recited in claim 7, further comprising a pocket attached to said front wall of said pouch.

* * * * *